US005762819A

United States Patent [19]

Franck et al.

[11] Patent Number: 5,762,819

[45] Date of Patent: Jun. 9, 1998

[54] BATHS AND PROCESS FOR CHEMICAL POLISHING OF STAINLESS STEEL SURFACES

[75] Inventors: Christian Franck, Sterrebeek; Jean-Marie Oreins, Haacht, both of Belgium

[73] Assignee: Solvay (Société Anonyme), Brussels, Belgium

[21] Appl. No.: 702,435

[22] PCT Filed: Mar. 13, 1995

[86] PCT No.: PCT/EP95/00942

§ 371 Date: Sep. 24, 1996

§ 102(e) Date: Sep. 24, 1996

[87] PCT Pub. No.: WO95/26428

PCT Pub. Date: Oct. 5, 1995

[30] Foreign Application Priority Data

Mar. 28, 1994 [FR] France ..... 94 03732

[51] Int. Cl.[6] ..... C23F 3/04; C09K 13/06

[52] U.S. Cl. ..... 252/79.1; 252/79.2; 252/79.4

[58] Field of Search ..... 216/90, 100; 252/79.1, 252/79.2, 79.4

[56] References Cited

U.S. PATENT DOCUMENTS

| | | | |
|---|---|---|---|
| 2,662,814 | 12/1953 | Swihart | 41/42 |
| 3,709,824 | 1/1973 | Oda et al. | 252/142 |
| 4,652,340 | 3/1987 | Tytgat et al. | 156/664 |
| 4,678,541 | 7/1987 | Tytgat et al. | 156/664 |

FOREIGN PATENT DOCUMENTS

| | | |
|---|---|---|
| 0019964 | 12/1980 | European Pat. Off. . |
| 0193239 | 9/1986 | European Pat. Off. . |
| 0206386 | 12/1986 | European Pat. Off. . |
| 2476146 | 8/1981 | France . |
| 50-133124 | 10/1974 | Japan . |
| 52072989 | 12/1975 | Japan . |
| 52-072989 | 6/1977 | Japan . |

OTHER PUBLICATIONS

English translation of the original Japanese patent application JP 52-072,989 of Oda et al.

Sharpe, A.G., "The Chemistry of Cyano Complexes of the Transition Metals", University Chemical Laboratory, Cambridge, England, Academic Press, pp. vii-xi and 109-115 (1976).

"Fiche Toxicologique No. 195: Hexacyanoferrate (3-) et Hexacyanoferrate (4-) de potassium" established by I.N.R.S., Paris (1984).

Tegart et al.: "Polissage électrolytique et chimique des métaux" [Electrolytic and chemcial polishing of metals]. Dunod, Paris, 1960, pp. 122-129. w/ translation.

Michael B. Bever: "Encyclopedia of Materials Science and Engineering", vol. 6, 1986, Pergamon Press, pp. 4806-4808.

ASTM Designation: D 523-85; "Standard Test Method for Specular Gloss", pp. 121-125.

*Primary Examiner*—R. Bruce Breneman
*Assistant Examiner*—George Goudreau
*Attorney, Agent, or Firm*—Spencer & Frank

[57] ABSTRACT

Phosphoric acid-free baths for chemical polishing of stainless steel surfaces, including, in aqueous solution, a mixture of hydrochloric acid and of nitric acid, an optionally substituted hydroxybenzoic acid, a cationic surfactant and ferricyanide complex ions.

15 Claims, No Drawings

BATHS AND PROCESS FOR CHEMICAL POLISHING OF STAINLESS STEEL SURFACES

FIELD OF THE INVENTION

The present invention relates to the composition of baths for chemical polishing of stainless steel surfaces.

TECHNOLOGY REVIEW

Chemical polishing of metal surfaces is a technique which is well known (Polissage électrolytique et chimique des métaux [Electrolytic and chemical polishing of metals]—W. J. Mc G. Tegart—Dunod—1960 —p.122 et seq.); it consists in treating the metal surfaces to be polished with oxidizing baths. Baths including a mixture, in aqueous solution, of hydrochloric, phosphoric and nitric acids are generally employed for chemical polishing of stainless steels. To improve the quality of the polish it is usual to incorporate suitable additives in these baths, such as surface-active agents, viscosity regulators and brighteners. Thus, U.S. Pat. No. 3,709,824 describes a composition of a bath for chemical polishing of stainless steel surfaces, including, in aqueous solution, a mixture of hydrochloric acid, of nitric acid and of phosphoric acid, a surfactant and sulphosalicylic acid as brightener.

Besides the well-known problems relating to the pollution due to phosphates, when spent baths are destroyed by a conventional physicochemical treatment, the precipitatation of phosphoric acid (in the form of calcium phosphates) gives rise to a large volume of sludge. This sludge is toxic and its removal is costly. Japanese patent application JP-A-52/72989 proposes to solve the pollution problem by employing polishing baths which are free from phosphoric acid and include, in aqueous solution, hydrochloric acid, nitric acid, at least one derivative chosen from sulphosalicylic acid, salicylic acid and thiourea, and a cationic surfactant. However, these phosphoric acid-free baths have the disadvantage of being effective only at a temperature which is higher than 80° C., with the result that their rate of polishing is very high; they do not permit slow and efficacious polishing of stainless surfaces.

The invention aims to provide polishing baths without phosphoric acid which are designed for carrying out slow and efficacious chemical polishing of stainless steel surfaces.

SUMMARY OF THE INVENTION

Consequently, the invention relates to phosphoric acid-free baths for chemical polishing of stainless steel surfaces, including, in aqueous solution, a mixture of hydrochloric acid and of nitric acid, an optionally substituted hydroxybenzoic acid and a cationic surfactant, these baths being characterized in that they include, in aqueous solution, ferricyanide complex ions.

In the baths according to the invention the hydroxybenzoic acid acts as a brightener. The hydroxybenzoic acid may be unsubstituted, such as salicylic acid, or substituted, such as 5-sulphosalicylic acid or aminosalicylic acid. Salicylic acid and 5-sulphosalicylic acid are preferred.

DETAILED DESCRIPTION OF THE INVENTION

In the baths according to the invention the cationic surfactant advantageously includes a quaternary ammonium salt. The quaternary ammonium salt is preferably selected from those which include at least one linear or branched, long-chain alkyl radical. Where appropriate it is preferred to select the quaternary ammonium salt from those in which the long-chain alkyl group contains at least 8 carbon atoms, preferably at least 10 carbon atoms, such as, for example, the lauryl, cetyl and stearyl groups. In addition to the long-chain alkyl radical defined above, at least one other linear or branched alkyl radical or a substituted or unsubstituted benzyl radical may be present. Examples are cetyldimethylbenzylammonium, distearyldimethylammonium, lauryldimethylbenzylammonium and lauryltrimethylammonium salts. Quaternary ammonium salts which are especially recommended belong to the class formed by the water-soluble alkylpyridinium, especially cetylpyridinium and laurylpyridinium, salts. The quaternary ammonium salts including a long-chain alkyl radical as defined above are preferably selected from the halides, in particular the chlorides. Alkylpyridinium chlorides are particularly preferred, especially laurylpyridinium chloride. Quaternary ammonium salts that can be employed in the baths according to the invention are available among the products of the Dehyquart® trademark (Henkel).

In the baths according to the invention the ferricyanide complex ions are complex cyanides of general formula $[Fe^{III}(CN)_6]^{3-}$, also called hexacyanoferrates (III). They may be present in the aqueous solution in the form of any dissolved compounds such as, for example, hexacyanoferric (III) acid, ammonium ferricyanide, and alkali and alkaline-earth metal ferricyanides. Preferred compounds are alkali metal ferricyanides, potassium ferricyanide being especially preferred.

In the chemical polishing baths according to the invention the respective contents of hydrochloric, nitric and hydroxybenzoic acids, of cationic surfactant and of ferricyanide complex ions are chosen as a function of the grade of the stainless steel subjected to the polishing and of the polishing conditions, especially of the profile of the steel article subjected to the polishing, of its volume, of the volume of the bath, of its temperature and of the agitation to which it is optionally subjected. They must consequently be determined in each particular case by routine laboratory tests.

In the baths in accordance with the invention the hydrochloric acid content of the aqueous solution is advantageously at least 1, preferably 2, moles per liter and generally does not exceed 6, preferably 5, moles per liter. The nitric acid content is advantageously at least 0.001, preferably 0.005, moles per liter of the aqueous solution and generally does not exceed 0.3, preferably 0.03, moles per liter of the aqueous solution. The hydroxybenzoic acid content is advantageously at least 0.1, preferably 1, mg per liter of the aqueous solution and generally does not exceed 15,000, preferably 7000, mg per liter of the aqueous solution. The cationic surfactant content is advantageously at least 0.1, preferably 1, mg per liter of aqueous solution and generally does not exceed 1000, preferably 100, mg per liter of aqueous solution.

The ferricyanide complex ion content in the chemical polishing baths according to the invention is preferably at least $1\times10^{-7}$ mole per liter of aqueous solution and, particularly preferably, the ferricyanide complex ion content is at least $1\times10^{-5}$ mole per liter. A content of at least $3\times10^{-5}$ mole per liter is very particularly preferred. The ferricyanide complex ion content preferably does not exceed 1 mole per liter and, particularly preferably, the ferricyanide complex ion content does not exceed $1\times10^{-3}$ mole per liter. A content which does not exceed $3\times10^{-4}$ mole per liter is very particularly preferred.

Baths in accordance with the invention which are suitable for ensuring the chemical polishing of surfaces made of chromium- and nickel-alloyed austenitic stainless steel, over a period which varies from 1 to 24 hours and at a temperature of between 20° and 80° C. are those in which the aqueous solution includes, per liter, from 2 to 5 moles of hydrochloric acid, from 0.005 to 0.03 moles of nitric acid, from 1 to 7000 mg of hydroxybenzoic acid, from 1 to 100 mg of the cationic surfactant, and from $1\times10^{-5}$ to $1\times10^{-3}$ mole of ferricyanide complex ions.

In a particular embodiment of the polishing baths according to the invention the latter contain, in the aqueous solution, an additive capable of decomposing nitrous acid. The function of this additive is to decompose at least a proportion of the nitrous acid which is formed during the polishing of a steel surface, as a result of an oxidation of ferrous ions released in the bath during the polishing. The additive capable of decomposing nitrous acid is preferably selected from urea and its derivatives, such as thiourea and urea homologues. The optimum content of additive capable of decomposing nitrous acid is from 0.01 to 5 g per liter of the aqueous solution. The baths in accordance with this embodiment of the invention are especially suited to the polishing treatments in which the ratio of the surface in contact with the bath to the volume of the latter is higher than 10 $m^{-1}$.

The baths according to the invention may optionally contain additives which are usually present in baths for chemical polishing of metals, for example surface-active agents other than the cationic surfactant defined above, alcohols and viscosity regulators.

The baths according to the invention may in addition contain other inorganic acids commonly present in the chemical polishing baths, for example sulphuric acid. They are, however, essentially free from phosphoric acid and phosphate ions.

The baths according to the invention are suitable for the chemical polishing of stainless steel surfaces. They are well suited to the polishing of austenitic steels containing between 16 and 26% by weight of chromium and between 6 and 22% by weight of nickel, such as steels of 18/8 and 18/10 grades. The baths according to the invention are especially well suited to the polishing of austenitic steels containing molybdenum. The austenitic steels, with or without molybdenum, are typically AISI steels 304, 304L, 316, 316L, 904 and 904L. A special feature of the baths according to the invention is that they effect the polishing of such steels at a slow speed. They can be employed at any temperatures which are lower than the boiling temperature of the bath. However, they have the remarkable special characteristic of exhibiting an outstanding effectiveness at temperatures which are lower than 80° C., more particularly lower than or equal to 70° C., at normal atmospheric pressure, and this facilitates their use and simplifies the measures to be taken in order to ensure the salubriousness of the polishing shops. A special feature of the baths according to the invention is that they permit slow polishing, and this makes them suitable for the polishing of large industrial pieces of equipment. The baths according to the invention have the additional advantage of effecting good quality polishing of assemblies which are welded according to the rules of the art.

The invention consequently also relates to a process for polishing a stainless steel surface, according to which the surface is placed in contact with a chemical polishing bath in accordance with the invention.

In the implementation of the process according to the invention the metal surface can be brought into contact with the bath in any suitable manner, for example by immersion. The time of contact of the surface to be polished with the bath must be sufficient to produce an efficacious polishing of the surface. However, it must not exceed a critical value beyond which the bath loses its polishing properties. The optimum contact time depends on many parameters, such as the steel grade, the configuration and the initial roughness of the surface to be polished, the composition of the bath, the working temperature, the agitation of the bath in contact with the surface and the ratio of the area of the surface to be polished to the volume of the bath; it must be determined in each individual case by routine laboratory work. The time of contact of the surface to be polished with the bath is, in general, at least one hour, preferably at least two hours. The time of contact generally does not exceed 24 hours and preferably does not exceed 12 hours.

In the implementation of the process according to the invention the temperature at which the bath is used is generally lower than its boiling temperature. The temperature of use is preferably lower than 80° C. Good results are obtained at a temperature which is lower than or equal to 70° C. The temperature of use of the bath is in general at least equal to the ambient temperature. The temperature is preferably at least 35° C.

In a preferred embodiment of the process according to the invention the bath is used, at normal atmospheric pressure, at a temperature of 35° to 70° C. and the surface to be polished is kept in contact with the bath for a period of between 2 and 12 hours.

EXAMPLES

The advantage of the invention will become apparent on reading the examples set out below.

In each of the examples described in what follows a stainless steel plate was immersed in a polishing bath maintained at a substantially constant temperature and subjected to moderate agitation. At the end of the immersion period the plate was withdrawn from the bath, rinsed with demineralized water and dried. The following parameters were measured:

the arithmetic mean roughness $R_a$, which is the mean deviation in relation to the mean surface of the plate [Encyclopedia of Materials Science and Engineering, Michael B. Bever, Vol. 6, 1986, Pergamon Press, pages 4806 to 4808]:

$$R_a=\frac{1}{L}\int_0^L |y(x)|dx$$

the measurements being performed with a sensor fitted with a point 10 μm in diameter and corresponding to a cut-off value equal to 0.25 mm;

the brightness of the surface at an incidence angle of 20 degrees (according to ASTM standard D523).

Example 1 (in accordance with the invention).

A plate made of austenitic stainless steel of the AISI 316 type was immersed in a polishing bath in accordance with the invention, including, per liter:

2.7 moles of hydrochloric acid, 0.01 mole of nitric acid, 10 mg of salicylic acid, 2 mg of the product Dehyquart®C, which contains laurylpyridinium chloride as main constituent, 40 mg of $K_3Fe(CN)_6$.

The operating conditions were as follows:

bath volume: 725 $cm^3$, area of the plate subjected to the polishing: 43 $cm^2$, bath temperature: 50° C., immersion period: 5 h 30 min.

The following results were obtained:

arithmetic mean roughness ($R_a$):

before the polishing: 0.28 μm, after the polishing: 0.13 μm, brightness: 25%.

Example 2 (in accordance with the invention)

A plate made of austenitic stainless steel of the AISI 904L type was immersed in a polishing bath in accordance with the invention, including, per liter:

4 moles of hydrochloric acid, 0.01 mole of nitric acid, 5 g of 5-sulphosalicylic acid, 10 mg of the product Dehyquart®C, which contains laurylpyridinium chloride as main constituent, 20 mg of $K_3Fe(CN)_6$.

The operating conditions were as follows:

bath volume: 1000 $cm^3$, area of the plate subjected to the polishing: 65 $cm^2$, bath temperature: 65° C., immersion period: 5 h.

The following results were obtained:

arithmetic mean roughness ($R_a$):

before the polishing: 0.17 μm, after the polishing: 0.11 μm, brightness: 15%.

Example 3 (not in accordance with the invention)

A plate made of austenitic stainless steel of the AISI 316 type was immersed in a polishing bath, including, per liter:

2.7 moles of hydrochloric acid, 0.01 mole of nitric acid, 10 mg of salicylic acid, 2 mg of the product Dehyquart®C, which contains laurylpyridinium chloride as main constituent.

The bath used consequently differs from the bath of Example 1 in the absence of potassium ferricyanide.

The operating conditions were as follows:

bath volume: 725 $cm^3$, area of the plate subjected to the polishing: 43 $cm^2$, bath temperature: 50° C., immersion period: 6 h.

The following results were obtained:

arithmetic mean roughness ($R_a$):

before the polishing: 0.27 μm, after the polishing: 0.31 μm, brightness: 2%.

A comparison of the results obtained in Example 1 (in accordance with the invention) with those obtained in Example 3 (not in accordance with the invention) reveals the progress brought by the invention, insofar as the roughness and the brightness which are obtained after the polishing are concerned.

Example 4 (in accordance with the invention)

Three plates made of austenitic stainless steel of different grades, AISI 304L, AISI 316L and AISI 316Ti respectively, were immersed together in a polishing bath in accordance with the invention, including, per liter:

2.3 moles of hydrochloric acid, 0.01 mole of nitric acid, 3 g of 5-sulphosalicylic acid, 0.1 g of the product Dehyquart®LDB, which contains lauryldimethylbenzylammonium chloride as main constituent, 100 mg of $K_3Fe(CN)_6$.

The operating conditions were as follows:

bath volume: 1050 $cm^3$, area of each plate subjected to the polishing: 63 $cm^2$, bath temperature: 50° C., immersion period: 4 h 30 min.

The following results were obtained:

| Steel | Arithmetic mean roughness ($R_a$) before the polishing | after the polishing | Brightness |
|---|---|---|---|
| AISI 304L | 0.31 μm | 0.17 μm | 9% |
| AISI 316L | 0.35 μm | 0.15 μm | 15% |
| AISI 316Ti | 0.27 μm | 0.17 μm | 22% |

What is claimed is:

1. A phosphoric acid-free bath for chemical polishing a stainless steel surface, including, in aqueous solution, a mixture of hydrochloric acid and of nitric acid, a substituted or unsubstituted hydroxybenzoic acid, a cationic surfactant, and ferricyanide complex ions.

2. The bath according to claim 1, wherein the hydroxybenzoic acid is selected from salicylic acid and 5-sulphosalicylic acid.

3. The bath according to claim 1, wherein the cationic surfactant includes a quaternary ammonium salt containing at least one alkyl radical containing at least 8 carbon atoms.

4. The bath according to claim 3, wherein the quaternary ammonium salt is selected from the halides.

5. The bath according to claim 4, wherein the quaternary ammonium salt is alkylpyridinium chloride.

6. The bath according to claim 1, characterized in that the ferricyanide complex ions are present in the solution in the form of potassium ferricyanide.

7. The bath according to claim 1, wherein the concentration of ferricyanide complex ions is from $1\times10^{-5}$ to $1\times10^{-3}$ mole per liter of solution.

8. The bath according to claim 1, including, per liter of aqueous solution, from 2 to 5 moles of hydrochloric acid, from 0.005 to 0.03 moles of nitric acid, from 1 to 7000 mg of hydroxybenzoic acid, substituted or unsubstituted, from 1 to 100 mg of the cationic surfactant, and from $1\times10^{-5}$ to $1\times10^{-3}$ mole of ferricyanide complex ions.

9. The bath according to claim 1, including, in the aqueous solution, an additive capable of decomposing nitrous acid.

10. A process for polishing a stainless steel surface, comprising:

placing the surface to be polished in contact with a chemical polishing bath, in accordance with claim 1, at a temperature of 35° to ≦70° C., for a period of between 2 and 12 hours, and removing the polished surface from the bath.

11. The bath according to claim 1, including in said aqueous solution, a substituted hydroxybenzoic acid and a cationic surfactant.

12. A phosphoric acid-free bath for chemical polishing a stainless steel surface, comprising:

an aqueous solution of a mixture of hydrochloric acid and nitric acid, a substituted or unsubstituted hydroxybenzoic acid selected from salicylic acid or 5-sulfosalicylic acid, a cationic surfactant selected from halides of a quaternary ammonium salt containing at least one alkyl radical containing at least eight carbon atoms, and ferricyanide complex ions present in a concentration from $1\times10^{-5}$ to $1\times10^{-3}$ mole/liter of solution.

13. A process for polishing a stainless steel surface, comprising:

placing the surface to be polished in contact with a chemical polishing bath, in accordance with claim 12, at a temperature of 35° to <70° C., for a period of between 2 and 12 hours, and removing the polished surface from the bath.

14. The process according to claim 10, including placing the surface to be polished in contact with said chemical polishing bath at a temperature of 35° to 65° C.

15. The process according to claim 13, including placing the surface to be polished in contact with said chemical polishing bath at a temperature from 35° to 65° C.

* * * * *